United States Patent [19]

Boutroy et al.

[11] 4,010,609

[45] Mar. 8, 1977

[54] JACK-PUMP DEVICE

[75] Inventors: Marcel Boutroy, Amblainville; Jacques Neyret, Gennevilliers, both of France

[73] Assignee: Hydrelem SA, Lausanne, Switzerland

[22] Filed: Feb. 24, 1976

[21] Appl. No.: 660,794

[30] Foreign Application Priority Data

Feb. 25, 1975 France ..... 75.05745
Feb. 16, 1976 France ..... 76.04124

[52] U.S. Cl. ..... 60/402; 60/473; 60/475; 60/477; 60/481

[51] Int. Cl.[2] ..... F15B 13/09

[58] Field of Search ..... 60/402, 406, 473, 474, 60/475, 477, 481, 482; 254/89 H, 93 H

[56] References Cited

UNITED STATES PATENTS

| | | | |
|---|---|---|---|
| 302,070 | 7/1884 | Watson | 60/481 |
| 2,473,694 | 6/1949 | Renick | 60/475 X |
| 2,563,912 | 8/1951 | Belinkin | 60/481 X |

*Primary Examiner*—Edgar W. Geoghegan
*Attorney, Agent, or Firm*—Young & Thompson

[57] ABSTRACT

The invention relates to improved jack-pump devices comprising a pump with a sliding piston forming first and second pump chambers, one on each side, a jack with a sliding piston forming first and second jack-chambers, one on each side, a first valve between the pump chambers, acting unidirectionally from the second to the first pump chambers, a second valve between the first chambers of the pump and the jack, and a communication device between the second chambers of the pump and the jack, the pump and jack pistons being slidably mounted and axially aligned in the same body filled with fluid, a fixed transverse partition disposed in the cylinder body between the two pistons, and a plunger for compensating variations of volume, slidably mounted in one of the two second chambers, close to the corresponding extremity of the body.

The main application is as a lifting device for regulating the height of members or parts of moving machines, of seats for chairs, vehicles, building stays, etc.

17 Claims, 15 Drawing Figures

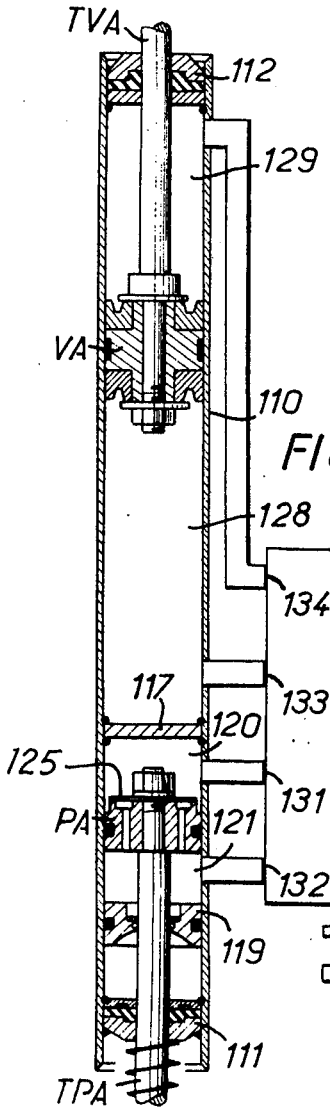
FIG. 12
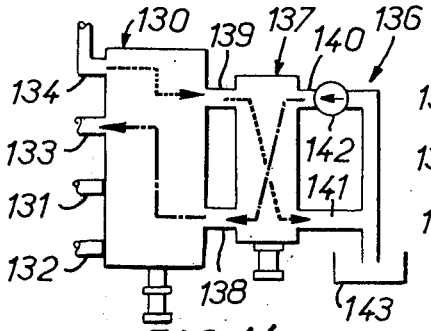
FIG. 13
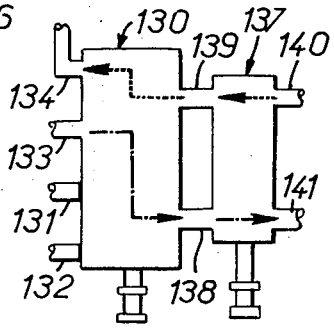
FIG. 14
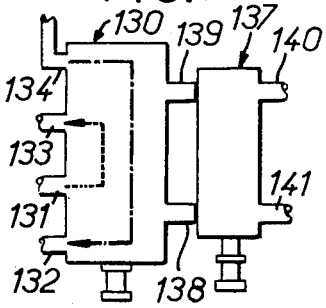
FIG. 15
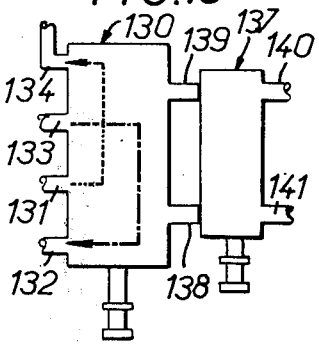
FIG. 9
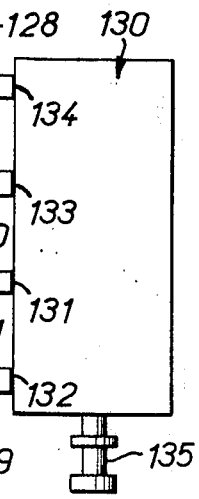
FIG. 10
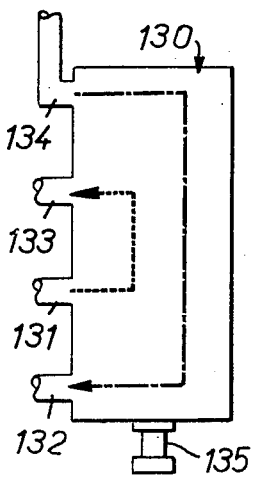
FIG. 11
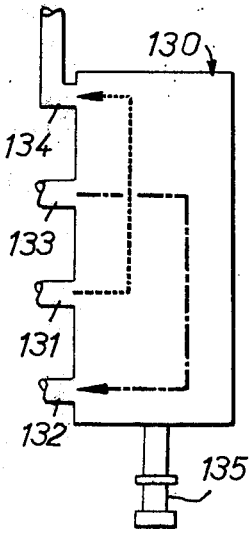

JACK-PUMP DEVICE

The present invention relates to a jack-pump device comprising a pump having a sliding piston which defines, on each side of itself, a first chamber and second chamber respectively, a jack having a sliding piston which defines on each side of itself, a first chamber and a second chamber respectively, a first valve means between the pump chambers, this first valve means being unidirectional in the direction going from the second to the first pump chamber, a second valve means between the first chambers of the pump and of the jack, and communication means between the two reserve chambers.

More particularly, the invention is concerned with such a jack-pump device forming a lifting device for the regulation of the height of all members, machines, apparatus, elements, moving members or parts, for example the moving parts of seats, office chairs and the like, of lorry seats, aircraft seats, moving parts of jacks or building stays, public works and mines, the moving parts of emergency valve control presses, etc.

The present invention has for its object a jack-pump device of monobloc construction, simple and robust, a small size and cheap.

According to the invention, a jack-pump device of the type indicated above is characterized in that the two pistons are axially in line and are slidably mounted in a single cylinder body filled with fluid, a fixed transverse partition being arranged in the said cylinder body between the two pistons, a plunger for compensating variations in volume being slidably mounted in one of the two second chambers in the vicinity of the corresponding extremity of the cylinder body.

In accordance with other characteristic features, the first two chambers are adjacent to the partition on each side of this latter while the second two chambers are arranged at the extremities of the cylinder bodies, the first valve means being mounted in the pump piston, the second valve means being mounted in the partition, the communication means between the second two chambers comprising an annular passage defined between the cylinder body and a jacket surrounding this body and holes formed in the cylinder body at the level of the second chambers. By virtue of this arrangement, all the various elements of the hydraulic device which are assembled in the unit are constituted by the cylinder body surrounded by the jacket and which forms a fluid-tight and self-sufficient unit.

According to the invention, in order to permit a return travel of the jack-piston towards a starting position, a third valve means is interposed between the first jack chamber and the communication means of the two second reserve chambers, the said third valve means being adapted to be controlled at will for forced opening with a view to the return of the jack.

In addition, according to the invention, in order to permit no-load fluid circulation when the jack piston has reached its extreme forward position and the pump continues to be actuated, the first jack chamber is adapted, in this extreme position of the jack piston, to be coupled to the communication means of the two second reserve chambers.

In an alternative form, the arrangement is such that the pump acts on the jack, not only during the outward stroke of this latter but also during the return stroke, which makes it possible to ensure the release by this means in applications such as stays or the like.

More particularly, it accordance with this alternative form, the jack-pump device is characterized in that the second valve means and the said communication means comprise distributor means with three positions; one of these is a neutral position in which each of the four said chambers is isolated from the others; one is an active outward position in which the two first chambers are coupled together and the two second chambers are connected; and the third is an active return position in which the first chamber of the pump is coupled to the second chamber of the jack and the first chamber of the jack is coupled to the second chamber of the pump.

In this way, depending on the active position in which the distributor is placed, the desired travel of the jack is obtained, either outgoing or return, by acting on the pump. When the distributor is placed in the neutral position the jack is held absolutely motionless.

The distributor means are preferably provided on the outside of the cylinder body in the vicinity of the place where the said transverse partition is located.

According to another alternative form, the operation of the jack is provided for by means of a hydraulic power station including a pump, and the pump serves as a manual stand-by in case of failure of this station.

According to this alternative form, the aboveindicated distributor means are utilized, but these means comprise in addition two supply orifices which can be coupled to the hydraulic power station and are such that in the neutral position these orifices are respectively coupled to the two jack chambers, while in the active positions they are isolated so as to permit the manual emergency use of the pump in the event of failure of the power station.

The hydraulic power station preferably comprises a source of fluid pressure, e.g. a pump, and a tank, and is associated with a reversing valve either for coupling one of the orifices with the source of pressure and the other orifice with the tank, or vice-versa.

Forms of embodiment of the invention are described below by way of example, reference being made to the accompanying drawings, in which:

FIG. 9 is a view in longitudinal section of still another alternative form of the jack-pump device, with a double-acting jack and a distributor occupying a neutral position;

FIGS. 10 and 11 are views of this distributor, but in which the latter respectively occupies on active outgoing position and an active return position;

FIG. 12 concerns an alternative form in which the distributor co-operates with a hydraulic power station including a pump, through the intermediary of a reversing valve, the distributor being in the neutral position while the reversing valve occupies an active outgoing position;

FIG. 13 is a view similar to FIG. 12, but in which the reversing valve occupies a return position;

FIGs. 14 and 15 are views similar to FIG. 12 but in which the reversing valve occupies a neutral position while the distributor respectively occupies an active outgoing position and an active return position with a view to the manual repositioning by the pump in the event of a failure of the hydraulic power station.

In the form of embodiment shown in FIGS. 1 to 6, the jack-pump device comprises a cylinder body 10 receiving a pump piston P having a rod TP passing out of one extremity, and a jack-piston V having a rod TV passing out of the other extremity.

Figure 1:
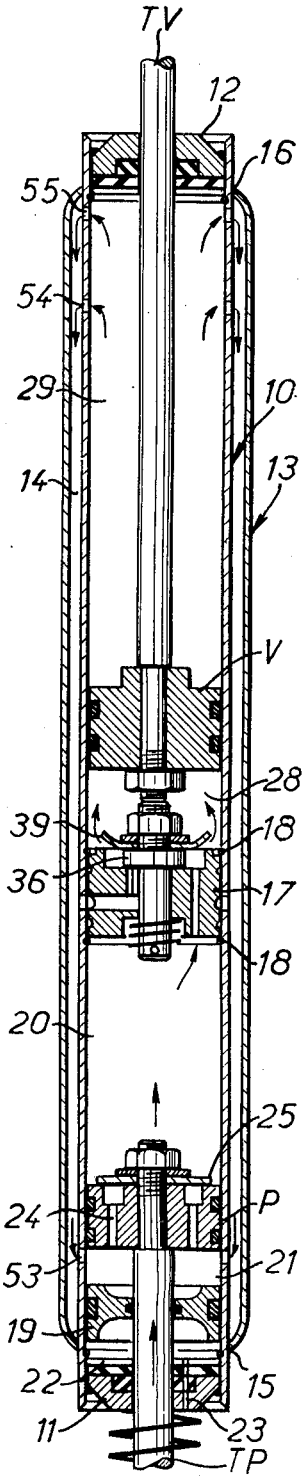
FIG. 1 is a view in longitudinal section of a jack-pump device according to the invention, illustrating the operation when the piston of the pump rises in order to cause the jack-piston to rise.
Figure 2:
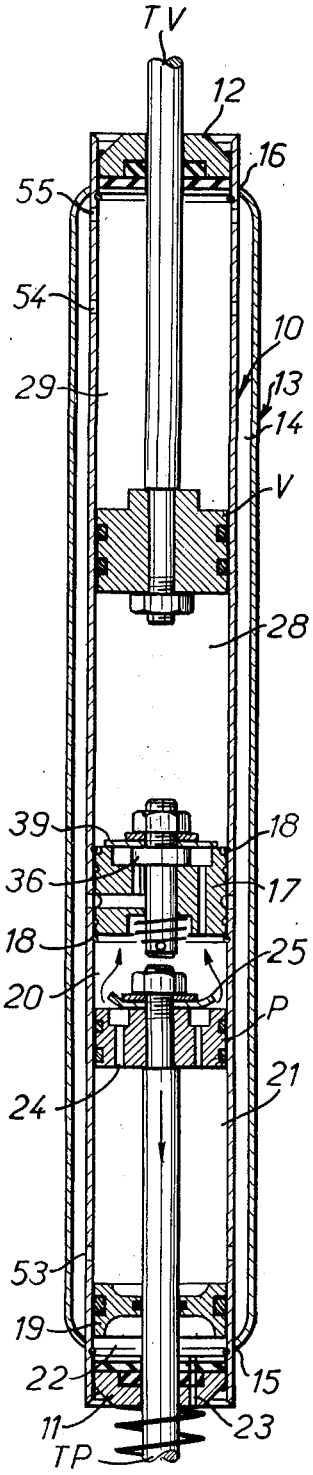
FIG. 2 is a view similar to FIG. 1, but in which the pump piston moves down whereas the jack-piston remains locked in a stationary position.
Figure 3:
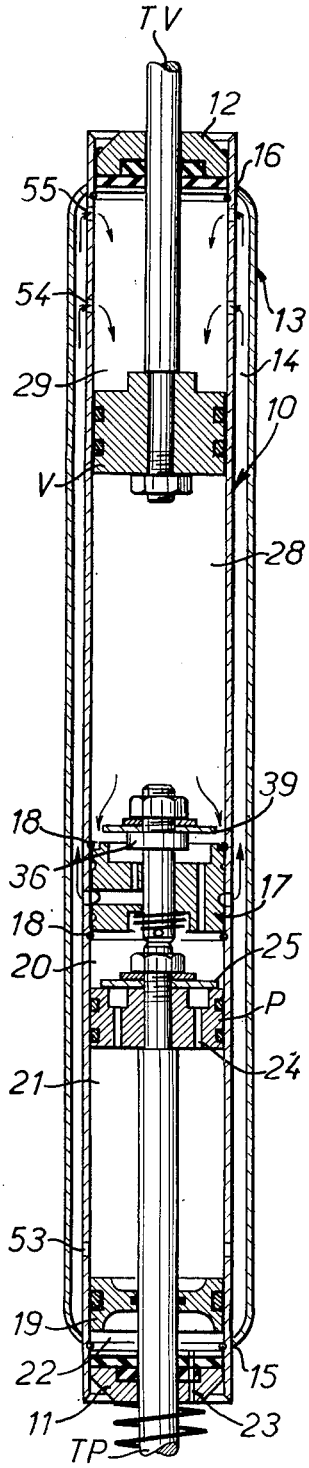
FIG. 3 is a view similar to FIG. 1 or FIG. 2, but in which the pump piston is moved forward beyond its normal travel so as to cause the downward movement of the jack, at will.
Figure 4:
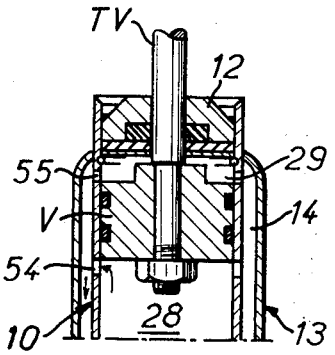
FIG. 4 is a partial view of the top portion of the jack-pump, showing the jack-piston in its most forward position, in which the actuation of the pump causes a no-load circulation of the fluid.

The rod TP is intended to be coupled to a pumping control, for example manual, giving to the piston P an alternating movement following a travel which is comprised between a withdrawn position shown in FIG. 1 and an advanced position shown in FIG. 2.

The rod TV is intended to be coupled either to the member which the jack-pump is to actuate in elevation when the cylinder body 10 is fixed, or to a fixed base when it is the cylinder body 10 which is coupled to the member to be actuated in elevation by the jack-pump. It may also be contemplated that the cylinder body 10 and the rod TV are not fixed either one or the other, but are coupled respectively to two movable portions which the jack-pump is to move away from each other.

To give an example in an application of the jack-pump to an adjustable office chair, the device is utilized in a position upside down with respect to that shown in FIG. 1. The rod TV is placed at the bottom and is mounted on a fixed base of the armchair, while the cylinder body 10 is coupled to the movable seat, the said rod TP being placed at the top and connected to a lever placed within reach of the user for pumping as to modify the adjustment in height of the armchair.

The cylinder body 10 is formed by a cylindrical tube closed at its two extremities by covers 11 and 12. A jacket 13 also formed by a cylindrical tube, surrounds the tube 10 in such a manner as to form with this latter an annular passage 14. In the example shown in FIGS. 1 to 6, the tube 13 is welded at its extremities at 15 and 16 to the tube 10, that is to say independently of the covers 11 and 12. The extremities of the tube 13 are folded back and are advantageously produced by hot-punching.

The cylinder body 10 and the space 14 are filled in a fluid-tight manner with a hydraulic fluid such as oil.

A fixed transverse partition 17 is mounted in the cylinder body 19 in an intermediate position between the covers 11 and 12 and is retained there by appropriate means such as circlips 18 for example.

In the space of the cylinder body 10 which is positioned between the cover 11 and the partition 17 is slidably mounted the pump piston P. The piston P has its rod TP passing through the cover 11 in a fluid-tight manner and passing out of the cylinder body so as to be coupled to the pumping control.

The volume-compensation plunger or diaphragm 19 is slidably mounted in a fluid-tight manner in the cylinder body 10 and around the rod TP. A first pump chamber 20, referred to as the working transmitter chamber, is defined in the cylinder body 10 between the partition 17 and the piston P, while a second pump chamber 21, referred to as the reserve chamber, is defined in the cylindrical body 10 between the piston P and the diaphragm 19.

Between the diaphragm 19 and the cover 11 there is formed in the cylinder body 10 a chamber 22 which is put into communication with the atmosphere by means of an orifice 23 formed in the cover 11. The orifice 23 may be closed after the chamber 22 has been filled with an inert gas of the nitrogen type. In this case, the apparatus can be employed in all media: free air, under water, in vacuum, etc.

Figure 5:
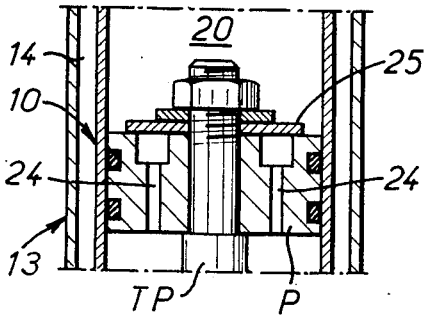
FIG. 5 is a view of a larger scale of the pump piston showing a first clapper-valve mounted on this piston.

As shown in FIG. 5, the pump-piston P has a circular row of orifices 24 which pass straight through it. On the face of the piston P which is exposed to the working chamber 20 is mounted an elastic disc 25 which covers the orifices 24 in such a manner as to form a clapper, known as the first clapper 25.

In the space of the cylinder body 10 which is disposed between the cover 12 and the partition 17, is slidably mounted the jack-piston V. The piston V has its rod TV passing through the cover 12 in a fluid-tight manner and passing out of the cylinder body 10 so as to be coupled to the member to be actuated.

A first jack chamber 28, referred to as the work receiving chamber, is formed in the cylinder body 10 between the fixed partition 17 and the jack-piston V while a second jack chamber 29, referred to as the reserve chamber, is defined in the cylinder body 12 between the cover 12 and the jack-piston V.

Figure 6:
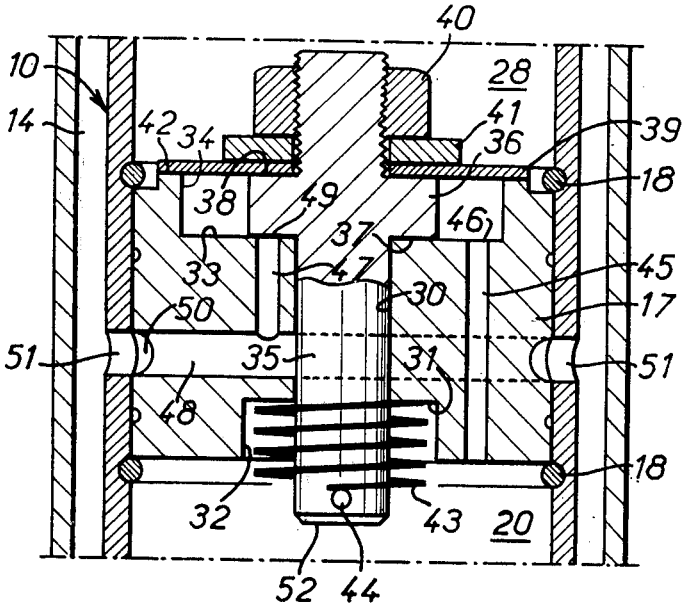
FIG. 6 is a view to a still larger scale of the partition of the cylinder body, and shows a second and third valves mounted in this partition.

The fixed partition 17 is provided with a central bore 30 (see FIG. 6). On the side of the chamber 20, this bore 30 is extended through the intermediary of a shoulder 31, by a bore 32 of larger diameter. On the side of the chamber 28, the bore 30 is extended through the intermediary of a shoulder 33 by a bore 34 of larger diameter.

In the bore 30 is slidably engaged a shaft 35 having, at the level of the bore 34, a flange 36 having a face 37 adapted to be applied against the shoulder 33, while the other face 38 of the flange 36 receives an elastic disc 39. The flange 36 is rigidly fixed on the shaft 35 by a nut 40, with the interposition of a washer 41.

The peripheral portion of the elastic disc 39 is intended to be applied against an annular terminal seating 42 of the partition 17 surrounding the bore 34. A spring 43 surrounds the shaft 35 inside the bore 32, and is applied between the shoulder 31 and a diametral pin 44 of the shaft 35. The spring 43 tends on the one hand to maintain the flange 36 applied against the shoulder 33 and on the other hand the disc 39 is held applied against the face 42.

One or a number of orifices 45 are formed in the part 17 in such a manner as to cause the chamber 20 to communicate with the bore 14. These orifices open into the shoulder 33 at 46, that is to say at the exterior of the flange 36. The elastic disc 39 thus forms a clapper, referred to as the second clapper 39, between the work-transmitter chamber 20 and the work-receiving chamber 28.

One or more channels 47-48 are formed in the partition 17 and comprise a portion 47 parallel to the axis and a radial portion 48. The portion 47 opens at 49 in the shoulder 33 forming a seating, so as to be capable of being closed by the flange 36. The radial portion 48 opens into a peripheral annular groove 50 of the partition 17. The groove 50 communicates in turn by one or more holes 51 formed in the tube 10, with the annular space 14.

The flange 36 forms a clapper, referred to as the third clapper 36, between the chamber 28 and the annular space 14. This clapper is opened by action of the end face 52 of the shaft 35.

The annular space 14 communicates with the reserve chamber 21 by one or a number of orifices 53, and communicates with the reserve chamber 29, on the one hand by one or more orifices 54 and on the other hand by one or more orifices 55.

The orifices 54 are axially spaced apart from the orifices 55 by a distance corresponding substantially to the height of the piston V in such manner that when the piston V occupies its most advanced position (see FIG. 4), the orifices 54 are permitted to communicate with the chamber 20, while the orifices 55 continue to communicate with the chamber 29.

The operation is as follows:

It will be assumed that the jack-piston V is in its most withdrawn position, defined by its abutment against the partition 17, and that the pump piston P is also in its most withdrawn position shown in FIG. 1, in which it is located immediately above the orifices 53.

In order to cause an upward movement of the rod TV of the jack, the pump is actuated by giving an alternating movement to its rod TP, in such manner that the piston P has an outgoing and return travel between the most withdrawn position shown in FIG. 1 and its most advanced position shown in FIG. 2.

During the outward travel of the piston P from the most withdrawn position, the hydraulic fluid such as oil contained in the work transmitter chamber 20 tends to be expelled from this chamber and cannot pass into the reserve chamber 21 due to the fact that the clapper 25 is powerfully applied by the oil pressure against the orifices 24. The oil from the chamber 20 is permitted to enter the work receiving chamber 28 by passing through the orifices 45 and into the bore 34 and is then permitted to lift the clapper 39 from its seating 42.

The oil from the chamber 20 does not lift the shaft 35 by action on the terminal section 52, since the oil pressure of the chamber 28 acts in the opposite direction on the greater section of the clapper 39, whereas furthermore the spring 43 tends to maintain the clapper 39 applied against the seating 42 and the clapper 36 applied against the seating 33.

The oil thus passing from the chamber 20 to the chamber 28 lifts the piston V. The oil from the chamber 29 which can be driven from this latter through the holes 54 and 55 passes through the peripheral annular space 14 and through the holes 53 so as to reach the chamber 21 which increases in volume by exactly the same quantity as the chamber 29 itself reduces in volume, since in the example shown in FIGS. 1 to 6, the pistons P and V have the same section, being slidably engaged in the same section of the tube 10, while the rods TP and TV for their part have the same section.

If the desired upward movement of the piston V is obtained after all or part of the outward stroke of the piston P, the pumping is stopped and the piston V is held locked stationarily by virtue of the hydraulic lock constituted by the fluid in chamber 28 supported against the closed clapper 39 (see FIG. 2).

It is possible to cause the pump to return to its most withdrawn position by making the rod TP to move down while the piston V is held locked in a stationalry position. The oil passes without difficulty from the chamber 21 to the chamber 20 by lifting the clapper 25. Since the section of the chamber 21 is smaller than the section of the chamber 20 due to the presence of the rod TP, the diaphragm 19 is allowed to move down so as to ensure a compensation for the variations in volume.

If the regulation in height of the rod TV makes necessary a fresh upward movement of the piston V, it is only necessary to begin the pumping again, moving the piston P upwards until the piston V has reached the desired height. The operation is similar to that which has previously been described.

It may happen that the piston V reaches its most advanced position in which it is in abutment against the cover 12 and it must not be permitted that continuation of pumping is liable to cause damage to the apparatus. For that reason, in the most advanced position of the piston V shown in FIG. 4, this piston V uncovers the orifices 54 and the pumping effected by alternating movement of the piston P results solely in a no-load circulation of the oil passing from the chamber 20 through the orifices 54 into the annular passage 14, and then through the orifice 53 into the chamber 21, while the chamber 29 is itself put into communication with the bore 14 through the orifices 55.

In order to cause the piston V to move down again, it is necessary to move the piston P forward beyond the most advanced position of its normal travel (see FIG. 3) so that the piston P lifts the shaft 35. In this case, the chamber 28 is put into communication with the orifices 47, 48 by lifting the clappers 39 and 36 and the holes 51 communicate with the passage 14 which in turn communicates by the holes 54 and 55 with the chamber 29, while a communication is also established between the chamber 28 and the chamber 20 through the orifices 45.

The piston V is thereafter free to move down by the release of the hydraulic fluid previously locked in the chamber 28. It should be noted that the diaphragm 19 may be displaced freely in order to compensate for the differences of variations of volume due to the presence of the rods TP and TV.

Figure 7:
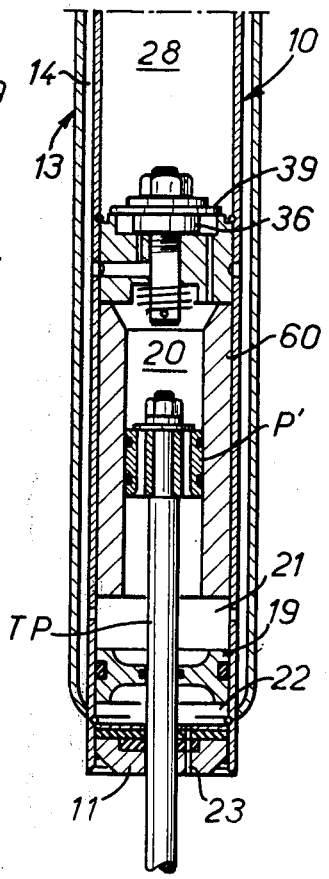
FIG. 7 is a partial view of an alternative form in which the bore of the pump is made smaller than that of the jack.

Reference will now be made to FIG. 7 in which the arrangement is similar to that which has been described with reference to FIGS. 1 and 6, but in which the piston indicated by P′ is permitted to slide in a bushing 60 mounted in the interior of the cylinder body 10 in order to reduce the active section of the pump with a view to obtaining demultiplication of the lifting control. The operation is similar to that previously described.

Figure 8:
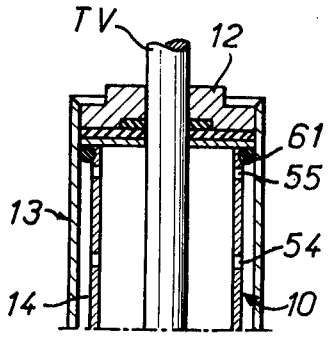
FIG. 8 is a partial view of another alternative form relating to the fixing of the external jacket to the cylinder body.

In another alternative form shown in FIG. 8, the external jacket 13 instead of being directly welded at 18 on the tube 10, is fixed to the covers 11 and 12. FIG. 8 illustrates a fixing arrangement of this kind on the cover 12. A toric joint 61 is provided between the tubes 10 and 13 and is arranged in contact with the cover 12 so as to ensure fluid-tightness.

In another alternative form of embodiment shown in FIGs. 9 to 11, the jack-pump device comprises a cylinder body 110 receiving a pump piston PA having a rod TPA passing out at one extremity, and a jack-piston VA having a rod TVA passing out of the other extremity.

The rod TPA is adapted to be coupled to a pumping control, manual for example, giving an alternating movement to the piston P. The rod TVA is adapted to be coupled either to the member that the jack-pump must actuate when the cylinder body 110 is fixed, or to a fixed portion when it is the cylinder body 110 which is coupled to the member that the jack-pump is to actuate. It may also be contemplated that the cylinder body 110 and the rod TVA are neither of them fixed, but they are respectively coupled to two movable parts which the jack-pump is to move to a distance apart.

The cylinder body 110 is formed by a cylindrical tube closed at its two extremities by covers 111 and 112. The cylinder body 110 is filled in a fluid-tight manner with a hydraulic fluid such as oil.

A fixed transverse partition 117 is mounted in the cylinder body 110 in an intermediate position between the covers 111 and 112.

In the space of the cylinder body 110 which is disposed between the cover 111 and the partition 117, the pump piston PA is slidably mounted. The rod TPA of the piston PA passes through the cover 111 in a fluid-tight manner and passes out of the cylinder body 110 so as to be coupled to the pumping control.

A volume-compensation plunger or diaphragm 119 is slidably mounted in a fluid-tight manner in the cylinder body 110 around the rod TPA. A first pump chamber 120 is formed in the cylinder body 110 between the partition 117 and the piston PA while a second pump chamber 121 is defined in the cylinder body 110 between the piston PA and the diaphragm 119.

A first clapper-valve 125 is formed on the piston PA and permits the circulation of fluid solely in the direction going from the second chamber 121 to the first chamber 120 of the pump.

In the space of the cylinder body 110 which is disposed between the cover 112 and the partition 117 is mounted the jack-piston VA. The rod TVA of the piston VA passes through the cover 112 in a fluid-tight manner and passes out of the cylinder body 110 so as to be coupled to the member to be actuated.

A first jack chamber 128 is formed in the cylinder body 110 between the fixed partition 117 and the jack-piston VA, while a second jack-chamber 129 is defined in the cylinder body 110 between the cover 112 and the jack-piston VA.

Whereas in the form of embodiment shown in FIGS. 1 to 6 it has more particularly been provided to arrange in the transverse partition 117 a valve for the circulation of fluid between the two first chambers 20 and 28, and also means of communication between the two second chambers 21 and 29, while the pump positively controls the jack solely in the outward direction of expansion, in this case the transverse partition 117 is constituted by a simple wall and there is provided a distributor arranged at the exterior of the cylinder body 110, preferably in the vicinity of the place in which the partition 117 is installed.

This distributor 130 has three positions: a neutral position (see FIG. 9), an active outgoing position, that is to say of expansion of the rod TVA (see FIG. 10), and an active return position, that is to say of retraction of the rod TVA (see FIG. 11).

The distributor 130 has four orifices 131, 132, 133 and 134 which are respectively coupled to the chambers 120, 121, 128 and 129, and comprises a control 135 which enables the distributor 130 to be changed over at will from one of the positions to another.

In the neutral position, the distributor 130 is such that the various orifices 131, 132, 133 and 134 are isolated each from the others (see FIG. 9).

In the active outgoing position (see FIG. 10), the distributor 130 is such that the orifices 131 and 133 communicate, thus coupling together the two first chambers 120 and 128, while the orifices 134 and 132 communicate, thus coupling together the two second chambers 129 and 121.

In the active return position shown in FIG. 11, the distributor 130 is such that the orifices 131 and 134 communicate, thus connecting the first chamber 120 of the pump with the second chamber 129 of the jack, while the orifices 133 and 132 communicate and thus couple the first chamber 128 of the jack with the second chamber 121 of the pump.

In order to move the jack either in one direction or in the other, it is necessary only to place the control 135 in the position of FIG. 10 or that of FIG. 11, depending on the operation desired and, when this is done, to bring back the distributor 130 into the neutral position of FIG. 9 by the control 135, so as to maintain the jack locked and perfectly stationary in the position chosen.

Reference will now be made to FIGS. 12 to 15, in which the arrangement is similar to that which has been described for FIGS. 9 to 11, but in which the distributor 130 is associated with a hydraulic power station 136 through the intermediary of a reversing valve 137. The distributor 130 will than have two additional orifices 138 and 139 for coupling to the reversing valve 137.

The distributor 130 is similar to that which has been described with reference to FIGS. 9 to 11, but in the neutral position in which it effectively isolates all the orifices 131, 132, 133 and 134 from each other, it positively closes the chambers 120 and 121 of the pump and causes the orifice 134 to communicate with the orifice 139 and the orifice 138 with the orifice 133.

The reversing valve 137 comprises two other orifices 140 and 141 for connection to the hydraulic station 136. There can be seen at 142 a source of fluid pressure, for example in the form of a motor-pump with or without a hydraulic accumulator. The motor-pump 142 is supplied from a tank 143 and delivers into the orifice 140. The tank 143 is connected to the orifice 141.

The reversing valve 137 has three positions: an outgoing position (see FIG. 12) in which the orifices 140 and 138 communicate and the orifices 139 and 141 communicate, a return position (see FIg. 13) in which the orifices 140 and 139 communicate and the orifices 138 and 141 communicate, and a neutral position in which the orifices 138 and 139 are closed.

During the course of normal working, the distributor 130 is in the neutral position in order to cause the orifice 138 to communicate with the orifice 133 and the orifice 134 with the orifice 139.

In order to actuate the jack VA in the outward direction by means of the station 136, the reversing valve 137 is placed in the outward position (see FIG. 12). The orifices 140 and 133 communicate via 138 and the orifices 134 and 141 communicate via 139.

In order to actuate the jack VA in the return direction by means of the station 136, the reversing valve 137 is placed in the return position (see FIG. 13). The orifices 140 and 134 communicate via 139 and the orifices 133 and 141 communicate via 138.

If the station 136 has a fault and if in spite of this it is desired to actuate the jack VA, the reversing valve 137 is put in the neutral position which closes the orifices 138 and 139 (FIGS. 14 and 15).

By placing the distributor 130 in the position of FIG. 14 or in that of FIG. 15, and actuating the pump piston PA, the jack VA is actuated in the desired direction, which constitutes a manual emergency replacement.

In another alternative form of construction (not shown), when the jack is single-acting as in FIGS. 1 to 8 and has a larger working section than the pump (see FIG. 7), means for releasing the jack (not shown) are provided and comprise especially a slide-valve operated by the pump piston and adapted to free an outlet orifice located in the first chamber of the pump.

In still another alternative form of embodiment (not shown), the plunger for compensating variations of volume is provided in the second chamber of the jack.

What we claim is:

1. A jack-pump device comprising a pump having a sliding piston defining on each side of itself a first and a second chamber respectively, a jack having a sliding piston defining on each side of itself a first and a second chamber respectively, a first valve means between the pump chambers, this first valve means being unidirectional in the direction going from the second to the first pump chamber, a second valve means between the first chambers of the pump and the jack, and communication means between the two second chambers of the pump and the jack, the two pistons being axially in line and mounted slidably in the same cylinder body filled with fluid, a fixed transverse partition being arranged in said cylinder body between the two pistons, said device further comprising a plunger for compensating variations of volume, said plunger being mounted slidably in one of the two second chambers in the vicinity of the corresponding extremity of said cylinder body.

2. A jack-pump device as claimed in claim 1, in which said volume-compensating plunger is slidably mounted in the second chamber of said pump.

3. A jack-pump device as claimed in claim 1, in which the piston of the pump is rigidly fixed on a rod which extends into the second chamber of said pump and which passes out of the cylinder body, and in which said rod passes in a fluid-tight manner through said compensating plunger.

4. A device as claimed in claim 1, in which said two first chambers are adjacent to the said partition on each side thereof, while the two second chambers are disposed at the extremities of said cylinder body.

5. A device as claimed in claim 1, in which said first valve means is mounted on the pump piston.

6. A device as claimed in claim 1, in which said second valve means is mounted on the partition.

7. A device as claimed in claim 1, in which said communication means between the two second chambers comprise an annular passage formed between the cylinder body and a jacket surrounding said body, and holes formed in the cylinder body at the level of said second chambers.

8. A device as claimed in claim 1, in which each of said pistons has a rod extending into the corresponding second chamber and passing out of said cylinder body.

9. A device as claimed in claim 1, in which, in order to permit a return travel of the jack-piston towards a starting position, a third valve means is interposed between the first jack chamber and the communication means of the two second chambers, said third valve means being intended to be actuated in forced opening with a view to the return of the jack piston.

10. A device as claimed in claim 9, in which said third valve means is monted in said partition and is actuated in forced opening in response to an action of the pump piston which is intended to be moved forward for that purpose beyond its normal working travel.

11. A device as claimed in claim 9, in which said second valve means is associated with said third valve means in such manner as to be actuated in forced opening when the third valve means is itself actuated in forced opening.

12. A device as claimed in claim 1, in which, in order to permit a no-load circulation of fluid when the jack-piston has reached its most advanced position while the pump continues to be actuated, the first chamber is adapted, in this most advanced position of the jack-piston, to be coupled to the communication means of said two second chambers.

13. A device as claimed in claim 1, in which said second valve means and said communication means comprise distributor means having three positions, of which one is a neutral position in which each of the four said chambers is isolated from the others, a second is an active outgoing position in which the two first chambers are coupled together and the two second chambers are coupled together, and a third active return position in which the first pump chamber is coupled to the second jack-chamber and the first jack-chamber is coupled to the second pump-chamber.

14. A device as claimed in claim 13, in which said distributor means are provided on the exterior of the cylinder body in the vicinity of the place where said transverse partition is installed.

15. A device as claimed in claim 13, in which said distributor means further comprise two supply orifices which can be coupled to a hydraulic power station including a pump and are such that, in the neutral position, these orifices are respectively coupled to the two jack-chambers, whereas in the active positions they are isolated so as to provide a manual repositioning of the pump in the event of failure of the power station.

16. A device as claimed in claim 15, in which said hydraulic power station comprises a source of fluid under pressure and a tank, and is associated with a reversing valve so as to couple either one of said orifices with the source of pressure and the other orifice with the tank, or vice-versa.

17. A device as claimed in claim 1, in which the jack has a larger working section than the pump, in which releasing means are provided and comprise a movable member actuated by the piston of the pump and adapted to free an orifice located in the first chamber of said pump.

* * * * *